US006814678B2

(12) United States Patent
Cyr et al.

(10) Patent No.: US 6,814,678 B2
(45) **Date of Patent: *Nov. 9, 2004**

(54) DEVICE FOR DETACHING LOCATOR FROM ARROW FOR TRACKING GAME

(75) Inventors: Maurice Cyr, Hampden, ME (US); Jon Simms, Hampden, ME (US)

(73) Assignee: Talon Industries, LLC, Hampden, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/656,608

(22) Filed: Sep. 5, 2003

(65) Prior Publication Data

US 2004/0048703 A1 Mar. 11, 2004

Related U.S. Application Data

(63) Continuation of application No. 10/094,907, filed on Mar. 12, 2002, now Pat. No. 6,764,420.

(51) Int. Cl.[7] ..... F42B 6/04
(52) U.S. Cl. ..... 473/578; 455/98
(58) Field of Search ..... 473/569, 570, 473/571, 578, 586; 342/386; 455/98

(56) References Cited

U.S. PATENT DOCUMENTS

| | | | | | |
|---|---|---|---|---|---|
| 3,865,374 | A | * | 2/1975 | Troncoso, Jr. | 473/578 |
| 4,704,612 | A | | 11/1987 | Boy | |
| 4,749,198 | A | * | 6/1988 | Brailean | 473/570 |
| 4,836,557 | A | * | 6/1989 | Polando | 473/578 |
| 4,858,935 | A | * | 8/1989 | Capson | 473/570 |
| 4,940,245 | A | * | 7/1990 | Bittle, Jr. | 473/570 |
| RE33,470 | E | | 12/1990 | Boy | |
| 4,976,422 | A | * | 12/1990 | Shimamura | 472/90 |
| 4,976,442 | A | | 12/1990 | Treadway | |
| 5,167,417 | A | * | 12/1992 | Stacey et al. | 473/570 |
| 5,188,373 | A | * | 2/1993 | Ferguson et al. | 473/583 |
| 5,333,881 | A | * | 8/1994 | Cugliari | 473/578 |
| 5,446,467 | A | * | 8/1995 | Willett | 342/386 |
| 6,409,617 | B1 | * | 6/2002 | Armold | 473/578 |
| 6,612,947 | B2 | * | 9/2003 | Porter | 473/578 |
| 2003/0132846 | A1 | * | 7/2003 | Hilliard | 340/573.2 |

* cited by examiner

*Primary Examiner*—John M. Hotaling, II
(74) *Attorney, Agent, or Firm*—Anthony D. Pellegrini

(57) ABSTRACT

A detachable nock for use with a bow hunting arrow, said arrow having a locating device associated with and transported by it. The detachable nock engages with the target animal and separates the locating device from the arrow as the arrow passes through the target animal, thereby retaining the locating device with the animal to permit tracking. The detachable nock may be constructed with various fixed or movable retention components to accommodate the needs of a wide range of hunters. The design of the detachable nock minimizes its impact on the flight of the arrow and allows the bow hunter to use any style of hollow-shaft arrow, broadhead, and fletching.

36 Claims, 9 Drawing Sheets

DEVICE FOR DETACHING LOCATOR FROM ARROW FOR TRACKING GAME

CROSS REFERENCE TO RELATED APPLICATION

This application is a continuation in part of U.S. Ser. No. 10/094,907, filed Mar. 12, 2002 now U.S. Pat. No. 6,764,420, entitled Device For Detaching Locator From Arrow For Tracking Game, which is hereby incorporated by reference.

BACKGROUND OF THE INVENTION

1. Technical Field

The invention relates generally to bow hunting for game animals and more particularly to the use of a detachable device used in combination with an arrow-mounted locating device to track and locate a wounded animal.

2. Description of Prior Art

Arrow-mounted tracking devices, and in particular arrow-mounted transmitting devices, are well known in the industry. Several devices have been developed for tracking and locating game animals that have been wounded by bow hunters. These devices range from trailing a string or thread from an arrow, releasing paint or smoke from an arrow, and equipping an arrow with an electronic transmitting device. U.S. Pat. No. 4,704,612, dated Nov. 3, 1987, to Dan D. Boy, and reissued as U.S. Pat. No. Re. 33,470, dated Dec. 4, 1990, discloses a method and apparatus for tracking an animal using an electronic transmitting device contained within an arrow shaft. While the Boy invention is an improvement over mechanical devices, such as arrows trailing string or thread which can become tangled or broken and which have limited range, and over chemical devices, such as paint or smoke emitting arrows which can be difficult to follow through thick underbrush or may be dispersed by wind, it nevertheless has a significant drawback. Modern compound and recurve bows used to hunt deer, bear, turkey, and other game animals typically shoot an arrow completely through the game animal at ranges of up to 45 yards. If the arrow passes completely through the game animal, which is the preferred method for killing a game animal with an arrow, the transmitting device will not work to track the wounded animal, but will merely provide the location of the spent arrow. U.S. Pat. No. 5,446,467, dated Aug. 29, 1995, to Eugene M. Willett, which discloses a detachable dart affixed to the exterior of an arrow and containing a transmitting device, which dart detaches from the arrow and remains attached to the wounded animal upon impact, theoretically avoids the disadvantage of the Boy invention but introduces another deficiency in that the size, weight, and position of the externally attached dart (along with its required counterweight) negatively impacts the flight of the arrow and reduces the accuracy of the arrow's flight, making it an unattractive alternative to a bow hunter.

U.S. Pat. No. 4,976,442, dated Dec. 11, 1990, to Woodrow L. Treadway, discloses an apparatus in which a transmitting device is located within the hollow shaft of an arrow and is removable therefrom through a notch cut into the arrow shaft, such that upon impact with an animal the transmitting device remains attached to the wounded animal irrespective of the ultimate location of the spent arrow. The Treadway apparatus, by enclosing the bulk of the removable transmitting device within the arrow shaft, does not, in theory, cause the severe degree of negative impact to the flight of the arrow and the corresponding reduction in the accuracy of the arrow's flight seen in the Willett invention; however, the notch cut into the arrow shaft requires archery hunters to use specially designed arrow shafts, at increased cost, rather than their preferred model, and the loss of a spent arrow which has passed through an animal entails the loss of the expensive custom designed shaft.

It is an object of this invention to provide a new and improved detachable device for use with an arrow-mounted locating device which is designed to attach the locating device to a game animal upon impact when the arrow passes through the animal, while minimizing the impact of the detachable device and locating device on the flight of the arrow, and allowing bow hunters to use their preferred model of arrow shaft rather than an expensive custom designed arrow shaft.

SUMMARY

In one aspect, the invention is directed to a detachable nock capable of carrying a locating device and suitably adapted for use with an arrow, and having the ability to separate the locating device from the arrow and securing the locating device to a game animal, said detachable nock comprising a nock body, a means incorporated into the nock body suitably adapted for carrying the locating device, a bowstring receiving means situated at the rear of the nock body, an attachment component for removably attaching the detachable nock to the arrow, and a retention component for securing the detachable nock to the game animal, whereby upon the arrow striking the game animal the retention component engages and lodges into the game animal with sufficient energy to detach the nock from the arrow and thus separate the locating device from the arrow and secure the locating device to the game animal.

This aspect may include one or more of the following features: the means for carrying the locating device being a hollow chamber integrated into the nock body; the bowstring receiving means being a flanged end cap having flanges forming a vertical notch; the flanged end cap being removable and being suitably adapted to provide access to the hollow chamber; the attachment component having a substantially cylindrical or tapered shape to be removably attached to the arrow shaft directly or into an adapter fitted into the arrow shaft; the attachment component comprised of multiple flexible flanges; the retention component being either fixed or engageable for engaging and lodging into the target; the fixed retention component having one or more fixed hooks; the fixed retention component having one or more grab members; the engageable retention component having one or more hinged hooks; the engageable retention component having one or more barb guards; and the engageable retention component having one or more pivoting grabbers.

Other features and advantages of the invention are described below.

DESCRIPTION OF THE INVENTION

Figure 1:
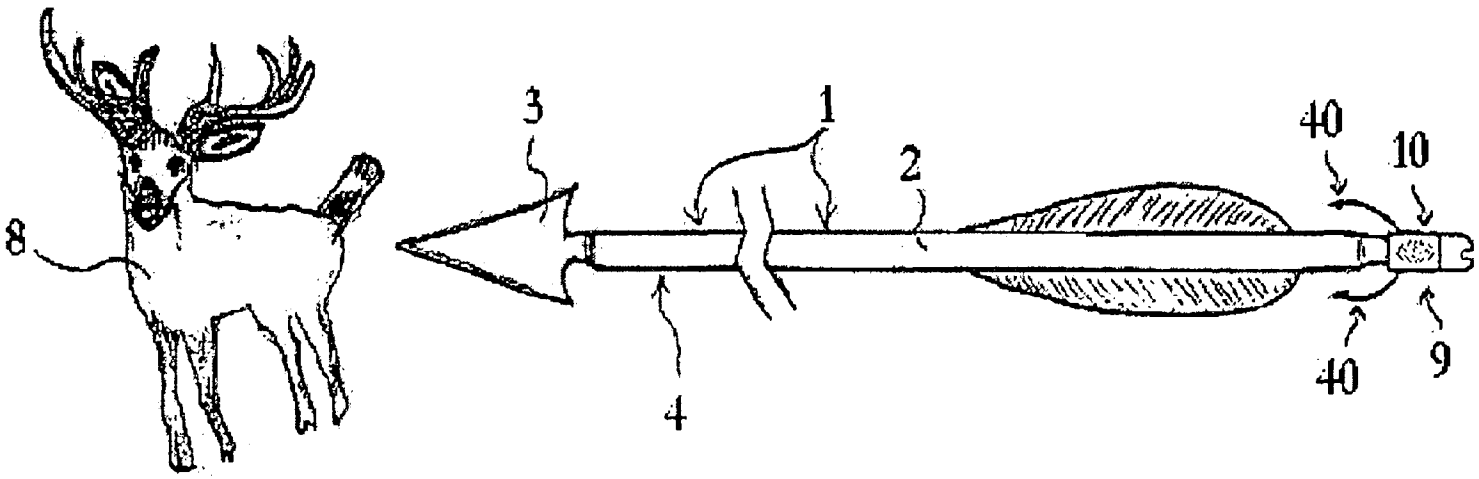
FIG. 1 is a side view of an arrow with the detachable nock inserted into the end of the arrow shaft.

FIG. 1 shows a perspective view of one embodiment of a detachable nock 9 as it is intended to be used with an arrow 1 and a locating device 7. The arrow 1, which is not claimed, has a hollow shaft 2 and an arrowhead 3 situated at the front end 4 of the arrow shaft 2 and an aperture 5 situated at the rear end of the arrow shaft 2. The locating device 7, which is not claimed, may be any type of locating device known in the art, but is preferably an electrically powered radio transmitting device capable of sending a signal to a handheld receiver.

Figure 2:
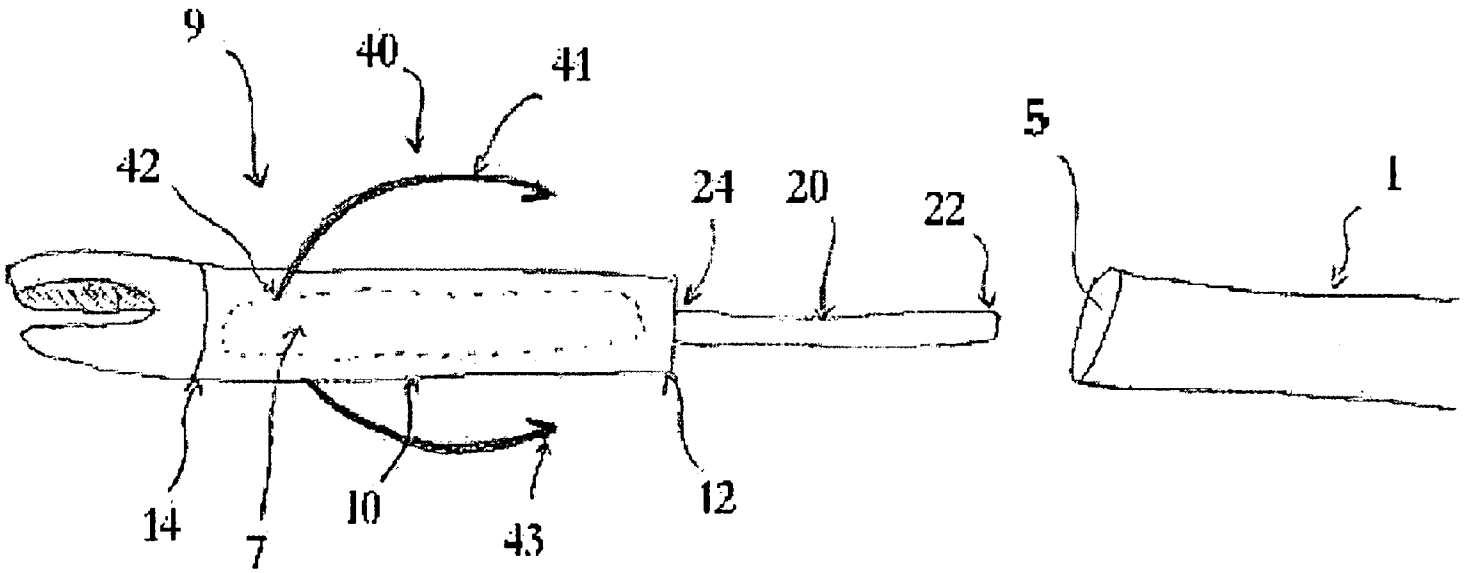
FIG. 2 is a side view of a detachable nock containing a locating device and having a retention component comprised of fixed hooks, ready for insertion into an arrow.
Figure 9:
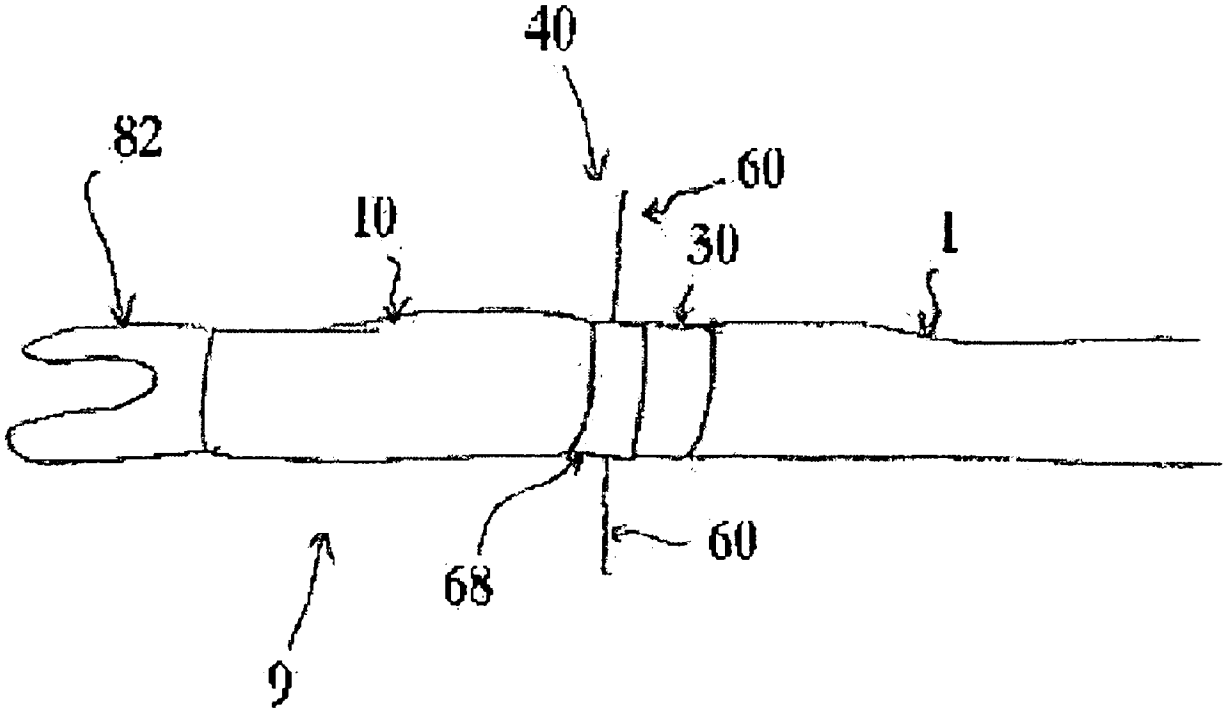
FIG. 9 is a side view of the detachable nock, having a retention component using grab members attached to a grab ring, fully inserted into an adapter.

The detachable nock 9, shown in more detail in FIGS. 2 and 9, includes a nock body 10 having a front 12 and a rear 14, a means for carrying the locating device 7, a bowstring receiving means to receive a bow string situated at the rear 14 of the nock body 10, an attachment component 20 situated at the front 12 of the nock body 10 suitably adapted for removably attaching the detachable nock 9 to the arrow shaft 2, and a retention component 40 for securing the detachable nock 9 to the target 8.

When the arrow 1 strikes a target 8 and continues on its flight path through the target 8, the detachable nock 9 engages the target 8 by the retention component 40 and detaches from the arrow 1, causing the locating device 7 to be separated from the arrow 1, resulting in the locating device 7 remaining attached to the target 8 to effect the goal of assisting in locating the target 8. This enhances the possibility that the locating device 7 will remain with the target 8 even though the arrow 1 has passed through the target 8, thereby allowing the locating device 7 to be used to track the target 8 and not the spent arrow 1.

Figure 3:
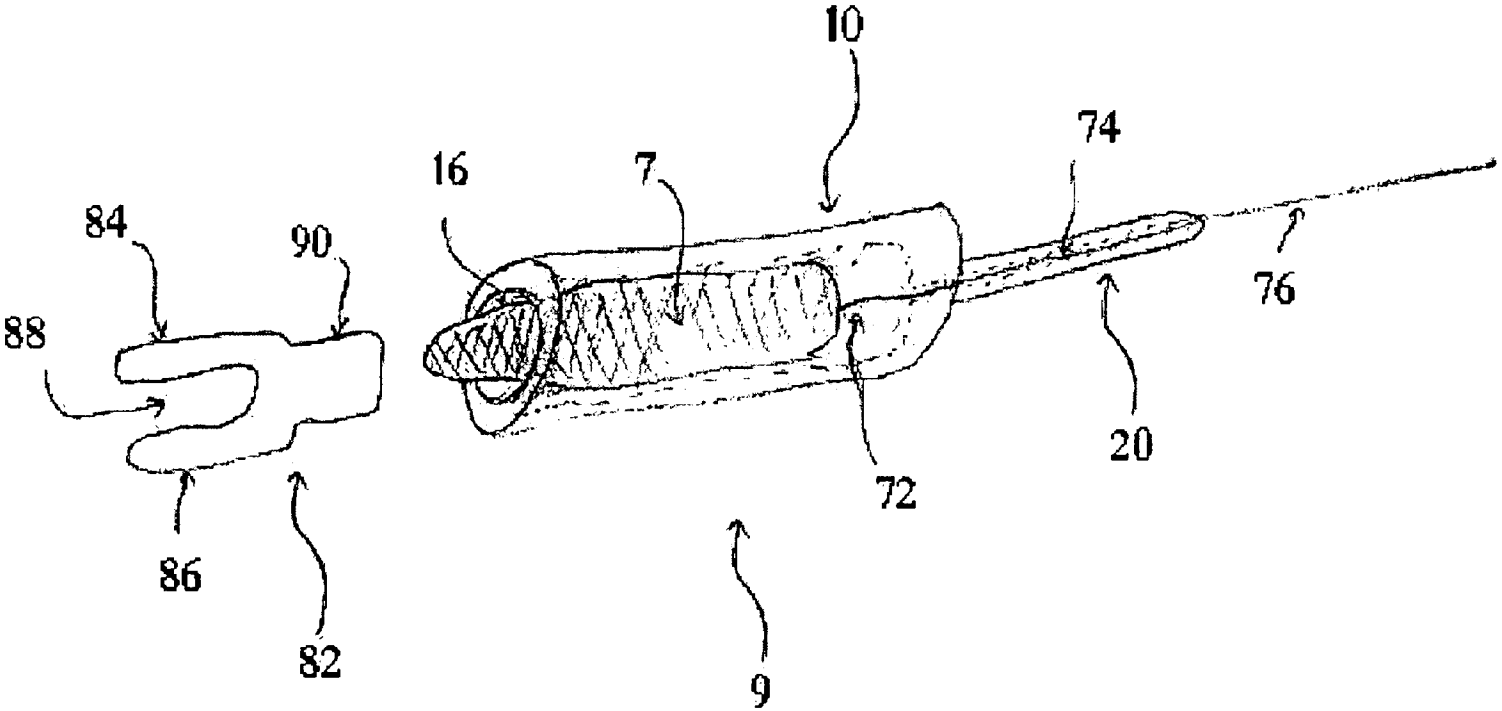
FIG. 3 is a perspective, cut-away view of a locating device partially inserted into the nock body of the detachable nock, having an external antenna extending from the nock body.

In one embodiment, shown in FIG. 3, the means for carrying the locating device 7 is a hollow chamber 72 situated within the interior of the nock body 10. The hollow chamber 72 is dimensioned to snugly accommodate the locating device 7 so as to prevent movement of the locating device 7 within the nock body 10 after the locating device 7 is inserted within the hollow chamber 72. The hollow chamber 72 may be of any suitable shape to accommodate the locating device 7, but the preferred embodiment uses a cylindrically shaped chamber and locating device.

The bowstring receiving means may be comprised of a flanged end cap 82 having a first flange 84 and a second flange 86, with the first and second flanges 84,86 depending generally rearward from the nock body 10 and being substantially parallel to each other. The flanges 84,86 are oriented to form a vertical notch 88 between the flanges 84,86 suitably adapted to receive a bow string. In one embodiment, the flanged end cap 82 is integrated into the rear 14 of the nock body 10.

In embodiments using a hollow chamber 72 to contain the locating device 7, the locating device 7 may be permanently located therein or may be removably located therein. A removable locating device 7 has the advantage of being replaced, repaired, or reused, or having its power supply replenished. In order to insert and remove the locating device 7 from the hollow chamber 72, the nock body 10 may incorporate an aperture 16 situated in the rear 14 of the nock body 10 which communicates with the hollow chamber 72. In this embodiment, the flanged end cap 82 of the bowstring receiving means is not integrated into the nock body 10, but rather is a separate component. It further contains a protrusion 90 situated opposite the flanges 84,86, with the protrusion 90 being suitably adapted to fit into the aperture 16 at the rear 14 of the nock body 10. The flanged end cap 82 is inserted into the aperture 16 at the rear 14 of the nock body 10 to securely attach the flanged end cap 82 to the nock body 10 and to seal off the hollow chamber 72, securing the locating device 7 therein. Removal of the flanged end cap 82 allows access to the hollow chamber 72 and to the locating device 7 contained therein. In an alternative embodiment, the rear aperture 16 of the nock body 10 is threaded, as is the protrusion 90 of the flanged end cap 82, such that the threads of the rear aperture 16 accommodate the threads of the protrusion 90, thereby allowing the flanged end cap 82 to be screwed into the nock body 10. The hollow chamber 72 is accessed by unscrewing the flanged end cap 82 from the nock body 10.

In yet another embodiment, where the locating device 7 uses an external antenna 76, the nock body 10 comprises a forward aperture 74 extending from the hollow chamber 72 through the front 12 of the nock body 10 such that an antenna 76 attached to the locating device 7 may pass out of the hollow chamber 72 through the forward aperture 74 and into the hollow arrow shaft 2 when the detachable nock 9 is attached to the arrow 1.

The detachable nock 9 is removably attached to the arrow shaft 2 by the attachment component 20, either directly or indirectly in conjunction with an adapter 30. One embodiment of the attachment component 20 of the detachable nock 9 is shown in FIG. 2. It is an extension of the nock body 10 projecting from the front 12 of the nock body 10 and aligned longitudinally with the intended direction of the flight of the arrow 1. It may have a substantially cylindrical shape or a tapered shape, to facilitate insertion into the arrow 1. The end of the attachment component 20 nearest the nock body 10 is designated the base end 24 and is integrated into the nock body 10. The end of the attachment component 20 furthest from the nock body 10 is designated the insertion end 22.

The attachment component 20 may be inserted, insertion end 22 first, directly into the arrow aperture 5, or into an adapter 30 which is fitted into the arrow aperture 5. In an embodiment where the attachment component 20 is inserted directly into the arrow shaft 2, the diameter of the attachment component 20 is just slightly smaller than the inside diameter of the arrow shaft 2, such that the detachable nock 9 is secured to the arrow 1 by friction. An alternative embodiment uses an attachment component 20 which is tapered. In such an embodiment, the insertion end 22 of the attachment component 20 has a diameter just slightly smaller than the inside diameter of the arrow aperture 5 and the base end 24 of the attachment component 20 has a diameter just slightly greater than the inside diameter of the arrow aperture 5. As such, insertion of the tapered attachment component 20 into the arrow shaft 2 causes the detachable nock 9 to become jammed into the arrow shaft 2, thereby securely attaching the detachable nock 9 to the arrow 1. The degree of force necessary to remove the detachable nock 9 from the arrow 1 can be more readily controlled by adjusting the amount of force applied to the detachable nock 9 when inserting a tapered attachment component 20 into the arrow shaft 2. This is a common method for attaching a nock to an arrow shaft. An appropriate force to apply when inserting the attachment component 20 into the arrow shaft 2 is such force that secures the detachable nock 9 firmly to the arrow 1, so that the detachable nock 9 does not move with respect to the arrow shaft 2 while the arrow 1 is at rest or in flight, yet permits an opposing force generated by the impact of the detachable nock 9 with the target 8 to overcome the friction of the attachment component 20 within the arrow aperture 5, thereby causing the detachable nock 9 to detach from the arrow 1.

Figure 4:
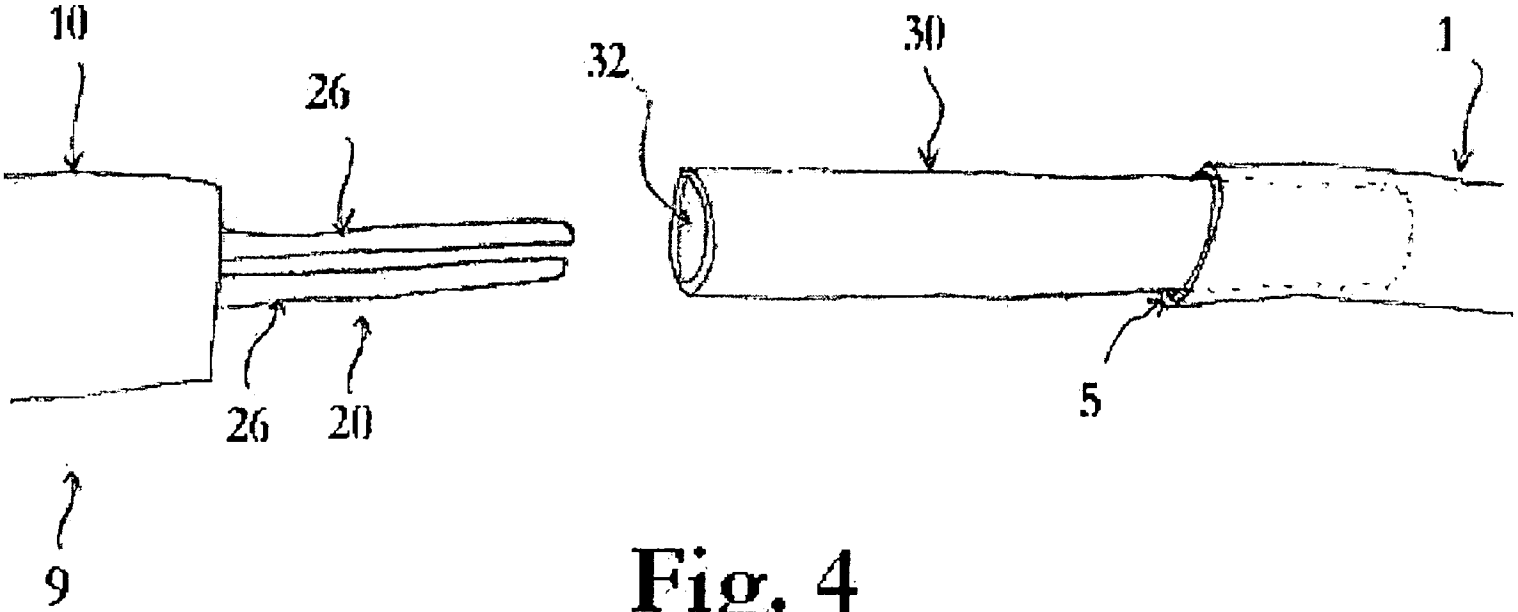
FIG. 4 is a side view of the attachment component comprising attachment flanges and used with an adapter.

In another embodiment, the attachment component 20 may be comprised of two or more independent flexible attachment flanges 26, as shown in FIG. 4, each flange disposed forward from the nock body 10 and oriented substantially parallel to the other. There is a slight separation between the attachment flanges 26, thereby allowing the attachment flanges 26 to flex toward each other. In this embodiment, the diameter of the attachment component 20 is slightly greater than the diameter of the arrow aperture 5 when the attachment flanges 26 are in their original, unflexed orientation, and the diameter of the attachment component 20 is slightly smaller than the diameter of the arrow aperture 5 when the attachment flanges 26 are flexed together. The attachment component 20 is inserted into the arrow shaft 2 by flexing the attachment flanges 26 together; once inside the arrow shaft 2, the attachment flanges 26 move towards their original orientation, thereby exerting a force against the inner surface of the arrow shaft 2 and securely attaching the detachable nock 9 to the arrow 1 by a combination of frictional and lateral forces. This embodiment has the advantage of maintaining appropriate holding forces between the detachable nock 9 and the arrow 1 even after repeated uses and repeated attachments and detachments.

In yet another embodiment, an adapter 30 is used with the attachment component 20. The adaptor 17 has a substantially cylindrical shape and has an outside diameter just slightly smaller than the inside diameter of the arrow aperture 5, such that the adapter 30 is suitably adapted to fit into the arrow aperture 5 and remain secured to the arrow 1 by frictional forces. Alternatively, an adhesive may be employed to secure the adapter 30 to the arrow 1. The adapter 30 has a central aperture 32 passing through its length and aligned substantially along its longitudinal axis. The central aperture 32 is defined by the inner surface of the adapter 30, with the diameter of the central aperture 32 being just slightly larger than the diameter of the insertion end 22 of the attachment component 20. The adapter 30 is suitably adapted to receive the attachment component 20 into the central aperture 32 of the adapter 30 such that upon the attachment component 20 being fully inserted into the central aperture 32 the detachable nock 9 is removably attached to the adapter 30. The attachment component 20 may be tapered as described above, to permit greater control over the force needed to detach the detachable nock 9 from the arrow 1. The attachment component 20 may alternatively be configured with attachment flanges 26, also as described above.

Figure 5:
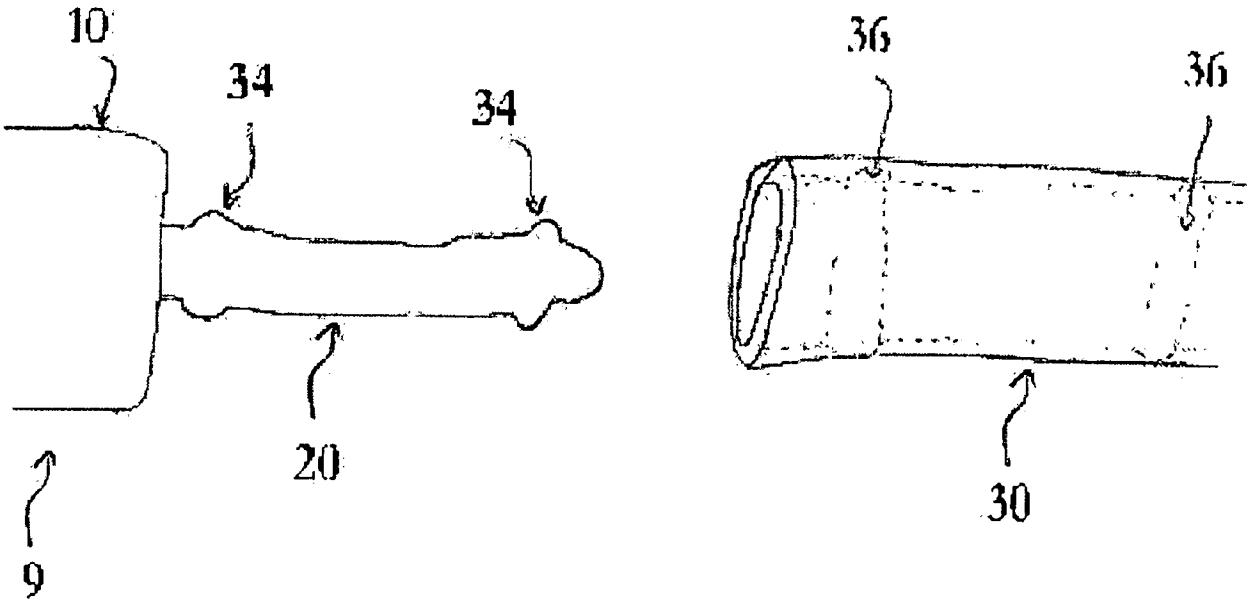
FIG. 5 is a side, cut-away view of the attachment component using annular protrusions and the adapter using annular channels.

In yet another embodiment, shown in FIG. 5, the attachment component 20 further comprises one or more annular protrusions 34 formed onto its surface and circumscribing the outside of the attachment component 20, with each annular protrusion 34 being slightly deformable. The adaptor 30 likewise has a like number of annular channels 36 formed into the inner surface and circumscribing the central aperture 32, where each annular channel 36 is suitably adapted to accommodate a corresponding annular protrusion 34. When the attachment component 20 is fully inserted into the central aperture 32 each annular protrusion 34 is aligned with and fits into a corresponding annular channel 36. Each annular protrusion 34 deforms slightly as the attachment component 20 is inserted into the central aperture 32 and thereafter returns to its original shape when aligned with a corresponding annular channel 36. This mechanism causes the attachment component 20 to snap into place and results in the attachment component 20 being more securely attached within the adapter 30 with a minimum of wiggle in the detachable nock 9 during flight, thereby improving the performance of the arrow 1. Alternatively, the arrangement of annular protrusions 34 and annular channels 36 may be reversed, with the annular protrusions 34 formed onto the inner surface and circumscribing the central aperture 32, and the annular channels 36 formed into and circumscribing the outside of the attachment component 20, with all else remaining the same.

The use of the adapter 30 permits a standard sized attachment component 20 to be used, with different sized adapters 30 to accommodate different styles of arrows 1. Alternatively, the adapter itself may be made in a standard size to fit within an existing arrow shaft adapter, such as the UNI BUSHING (TM) series. Thus, the manufacture of the detachable nock 9 is simplified and its use is made universal. The use of an adapter 30 also extends the length of the region of contact between the detachable nock 9 and the arrow 1 as compared, for example, to the use of a UNI BUSHING (TM). A longer region of contact imparts greater stability to the detachable nock 9 and reduces wiggle during flight.

The retention component 40 of the detachable nock 9 comprises a means for creating an impediment to the forward flight of the arrow 1 when the means comes in contact with the target 8. This impediment creates a force in opposition to the forward flight of the arrow 1 sufficient to detach the detachable nock 9 from the arrow 1, thereby effecting the purpose of the invention.

In one embodiment the means for creating an impediment is fixed in position relative to the nock body 10, such that the retention component 40 is always deployed and available for engagement upon contact with the target 8. This embodiment is the simplest and ensures that the detachable nock 9 is always ready to detach from the arrow 1.

One embodiment of the retention component 40 of the detachable nock 9 having a fixed means for creating an impediment is shown in FIG. 2. The retention component 40 is comprised of a fixed hook 41 fixedly attached to the detachable nock 9 in such a manner as the fixed hook 41 can engage and lodge into the target 8 upon contact. The fixed hook 41 includes a shaft, an attachment end 42, and a barbed end 43. The fixed hook 41 is fixedly attached to the nock body 10 at its attachment end 42. The shaft of the fixed hook 41 is curved towards the front of the detachable nock 9, forming a bend, so that the barbed end 43 of the fixed hook 41 is forwardly directed towards the arrowhead 3. The fixed hook 41 lies substantially in a plane aligned with the intended direction of the flight of the arrow 1. In this embodiment, there may be several fixed hooks 41 arrayed about the detachable nock 9. This embodiment is the simplest and has the highest level of effectiveness, as the retention component 40 is always in a position to engage a target 8.

Figure 8:
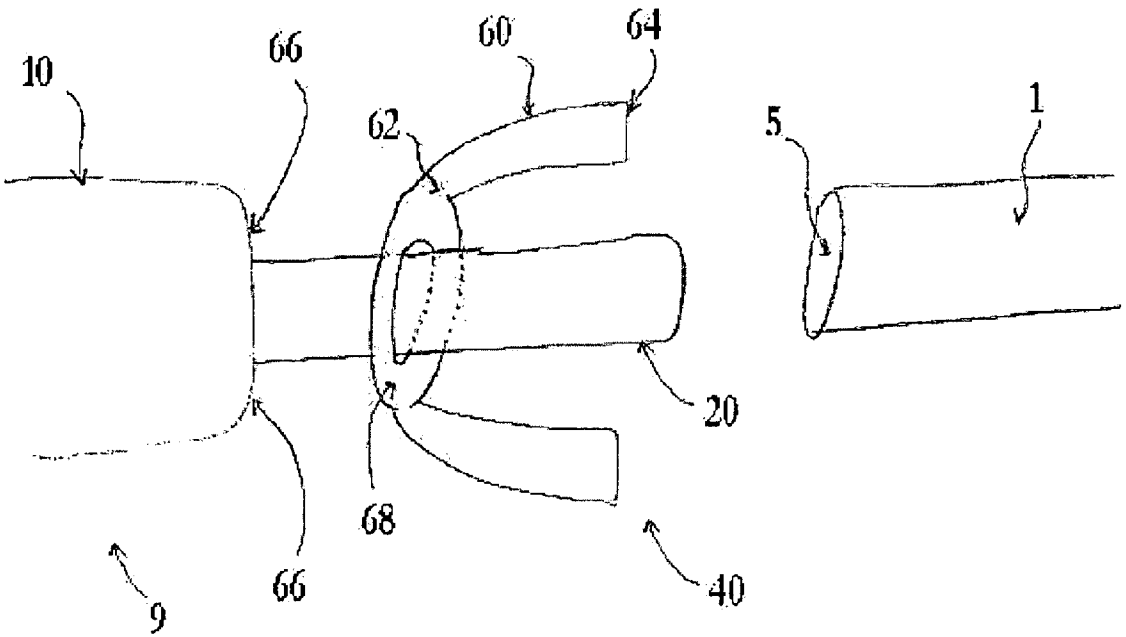
FIG. 8 is an exploded side view of the retention component using grab members attached to a grab ring.

The preferred embodiment of the retention component 40 of the detachable nock 9 is shown in FIG. 8. In this embodiment, the retention component 40 comprises a grab member 60 fixedly or removably attached to the detachable nock 9. The grab member 60 may be of any suitable shape or configuration, as long as it has an attachment point 62 and a contact element 64, with the attachment point 62 serving to attach the grab member 60 to the detachable nock 9 and the contact element 64 being oriented so that it presents an impediment to forward motion when it comes in contact with the target 8. One configuration of a grab member 60 is a substantially planar member situated substantially within a plane aligned with the anticipated direction of flight of the arrow 1, with the attachment point 62 of the grab member 60 being at the rear and the contact element 64 of the grab member 60 being the leading edge of the planar member and having a forward orientation. Other configurations are also effective.

In the preferred embodiment the grab member 60 is constructed of a material having the property of being deformable yet rugged, such that the grab member 60 may flex when subjected to a force while being resistant to breaking. In this embodiment the grab member 60 may be oriented at a slight angle away from the anticipated direction of flight, so that upon contact with and penetration into a target 8 the grab member 60 more easily flexes, exposing a greater surface area of the grab member 60 to the target 8 and creating a greater drag force sufficient to cause the detachable nock 9 to detach from the arrow 1. In the preferred embodiment, the contact element 64 may be tapered forward so that penetration of the target 8 by the grab member 60 is enhanced prior to flexing.

Rigid, non-flexing grab members 60 also have been demonstrated to be effective.

In one embodiment the grab member 60 may be fixedly attached to the nock body 10. In yet another embodiment there may be a plurality of grab members 60 fixedly attached to the nock body 10, disposed substantially uniformly about the circumference of the nock body 10.

In the preferred embodiment the base end 24 of the attachment component 20 has a diameter smaller than the diameter of the nock body 10, thereby forming a lip 66 at the junction of the base end 24 of the attachment component 20 and the nock body 10. The retention component 40 uses a grab ring 68 to which a grab member 60 is fixedly attached. The grab ring 68 has an inside diameter just slightly greater than the diameter of the base end 24 of the attachment component 20 and smaller than the outside diameter of the rear end of the arrow shaft 2, such that the grab ring 68 may be fitted over the base end 24 of the attachment component 20 and against the lip 66. In the preferred embodiment a plurality of grab members 60 are attached to the grab ring 68, disposed substantially uniformly about the circumference of the grab ring 68. When the detachable nock 9 is attached to the arrow 1 the rear end of the arrow shaft 2 prevents the grab ring 68 from sliding forward and the lip 66 prevents the grab ring 68 from sliding rearward, thereby holding the grab ring 68 securely onto the detachable nock 9. When an adapter 30 is used, the adapter 30 performs the same function as the arrow shaft 2. Upon contact with a target 8, the forces on the grab members 60 drive the grab ring 68 into the lip 66 of the nock body 10 with sufficient force to cause the detachable nock 9 to detach from the arrow 1. The grab ring 68 may be removed from the detachable nock 9 by sliding it forward off the attachment component 20 when the detachable nock 9 is detached from the arrow 1. This allows the retention component 40 to be replaced if one of the grab members 60 becomes damaged or breaks off, or to change the configuration of the retention component 40.

In another embodiment of the retention component 40, the means for creating an impediment to the forward flight of the arrow 1 has both an undeployed state and a deployed state. When in the undeployed state, the means is positioned close to or substantially within the nock body 10. When in the deployed state, the means is appropriately positioned relative to the nock body 10 to provide increased impediment to the forward flight of the arrow 1, relative to the impediment provided when in the undeployed state. In this embodiment, the retention component 40 is not always deployed and available for engagement, but rather requires a triggering event to alter the state of the means for creating an impediment from its undeployed state to its deployed state. Typically, the triggering event will be contact with the target 8.

This embodiment has the advantage of reducing the profile of the retention component 40 during aiming and shooting of the arrow 1, making the invention usable with a wider range of bows and arrow rest configurations. It also improves the safety to the shooter, since the undeployed state of the means for creating an impediment to the forward flight of the arrow presents a lessened likelihood that the retention component 40 will engage the shooter or the bow during aiming and shooting of the arrow 1.

Figure 6:
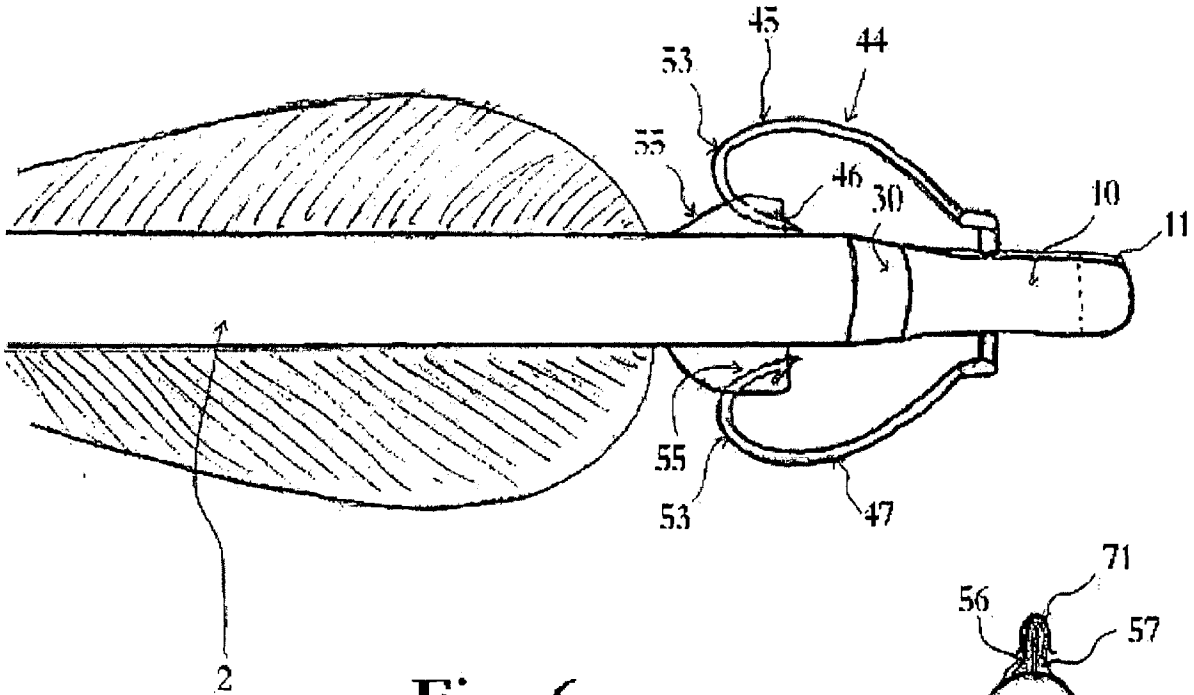
FIG. 6 is a side view of the detachable nock employing hinged hooks and barb guards.

An embodiment of the retention component 40 of the detachable nock 9 having both an undeployed and a deployed state is shown in FIG. 6. This embodiment comprises a hinged hook 44. The hinged hook 44 includes a grabbing prong 45 and a hinge. The grabbing prong 45 is a curved hook having a barbed end 46, a shaft 47, and a hinged end. The hinge is fixedly attached to the nock body 10 and accommodates the hinged end of the grabbing prong 45. The grabbing prong 45 is movably attached to the hinge in such a manner as permits the grabbing prong 45 to pivot forward and backward in a plane aligned with the intended direction of the flight of the arrow 1. The shaft 47 of the grabbing prong 45 is curved forming a bend 53, so that the barbed end 46 of the grabbing prong 45 is directed substantially towards the hinged end of the grabbing prong 45. When positioned for shooting the arrow 1, the grabbing prong 45 is positioned with its barbed end 46 directed towards the detachable nock 9 or, if the shaft 47 of the grabbing prong 45 is sufficiently long, towards the arrow shaft 2. The bend 53 of the shaft 47 then serves as a contact point with the target 8. When the bend 53 of the shaft 47 contacts the target 8, the grabbing prong 45 is pivoted rearward, opposite the direction of the flight of the arrow 1, causing the barbed end 46 of the grabbing prong 45 to pivot away from the detachable nock 9 (or the arrow shaft 2), exposing the barb 46 to the target 8 and engaging and lodging into the target 8. In this embodiment, a torsion spring may be integrated into the hinge so that the grabbing prong 45 is held in a forward position until it contacts the target 8. Alternatively, the hinge may comprise a folded plastic member constructed of materials having reflexive properties, such as polycarbonate, polyethelene, or polypropylene. In these embodiments, there may be several hinged hooks 44 arrayed about the detachable nock 9. The use of hinged hooks 44 permits the barbed ends 46 of the hooks 44 to be positioned out of the way, improving safety for the user.

Figure 7:
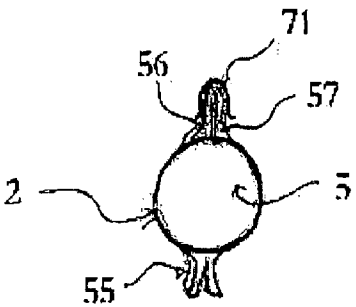
FIG. 7 is a cross-sectional view of the arrow shaft and barb guards shown in FIG. 6.

The embodiments of the retention component 40 of the detachable nock 9 which use hinged hooks 44 may also use barb guards 55 to further protect the user of the device from the barbed ends of the hinged hooks 44. One embodiment of barb guards 55 is shown in FIG. 7. In this embodiment, the barb guard 55 is comprised of two guard walls 56, 57 situated adjacent and parallel to each other, with a small separation between them to accommodate the barbed end 46 of a hinged hook 44. Each guard wall 56, 57 is composed of a semi-rigid material and can be of any appropriate shape, provided it has at least one straight edge. The two guard walls 56, 57 are attached along their straight edges perpendicularly to the detachable nock 9 in front of the hinged hook 44, and are situated substantially parallel to a plane aligned with the intended direction of the flight of the arrow 1. If the hinged hook 44 has a longer shaft 47, the guard walls 56, 57 may be attached perpendicularly to the arrow shaft 2 instead. When preparing the device for use, the user positions the barbed end 46 of the hinged hook 44 between the two guard walls 56, 57, thereby preventing the barbed end 46 to engage until it contacts the target 8. The barb guard 55 may also use a device for maintaining the barbed end 46 of the hinged hook 44 between the guard walls 56, 57 until the target 8 is engaged. Such a device may be a removable clip 71 situated over and compressing together the two guard walls 56, 57. When contact is made with the target 8 the removable clip 71 disengages from the guard walls 56, 57 and permits the hinged hook 44 to pivot out from between the guard walls 56, 57 and engage the target 8. There should be as many barb guards 55 as necessary to accommodate the number of hinged hooks 44 employed.

Another embodiment of the retention component 40 of the detachable nock 9 having both an undeployed and a deployed state is comprised of a pivoting grabber 100. In this embodiment, shown in FIGS. 10A, 10B, and 10C, the retention component 40 is situated substantially within the interior of the detachable nock 9 and upon contact with the target 8 is rotated out of the detachable nock 9 to engage and lodge into the target 8. While situated within the detachable nock 9 in its undeployed state the retention component 40 presents a more aerodynamic profile than while in the deployed state, improving the ability to shoot the arrow 1 from a variety of bows and arrow rests as well as protecting the user from barbs or other devices for engaging the target 8. When in the deployed state, the retention component 40 provides a greater ability to engage and lodge into the target 8.

Figure 10A:
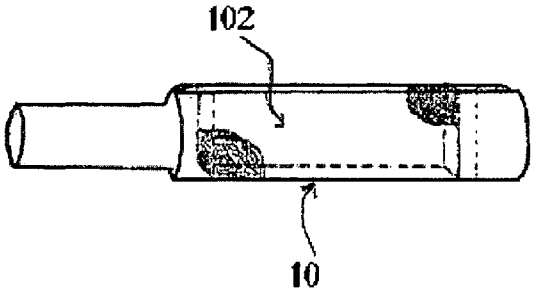
FIG. 10A is a side view of the grabber slot integrated into the nock body of the detachable nock.
Figure 10B:
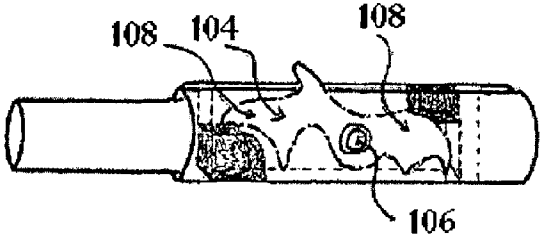
FIG. 10B is a side view of the pivoting grabber embodiment of the retention component of the detachable nock, with the pivoting grabber having two grab members and being rotated to the undeployed position.
Figure 10C:
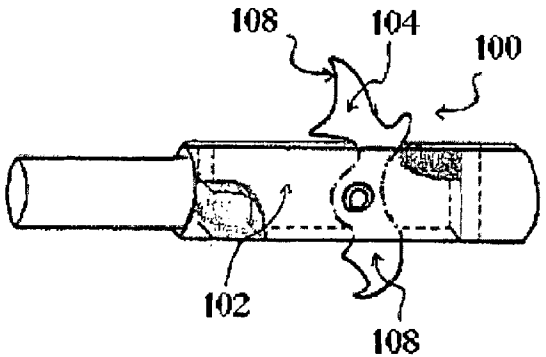
FIG. 10C is a side view of the pivoting grabber embodiment of the retention component of the detachable nock, with the pivoting grabber having two grab members and being rotated to the deployed position.

In this embodiment the engaging component of the retention component 40 is situated within a grabber slot 102 formed into the nock body 10, as shown in FIG. 10A. The grabber slot 102 is defined by substantially parallel sides forming a rectangular space, with at least one side being substantially open such that the grabber slot 102 is accessible from the exterior of the nock body 10. The engaging component comprises a pivoting grabber arm 104 which is disposed about and rotationally attached to a fulcrum 106 situated within the grabber slot 102 and fixedly attached to the nock body 10. The undeployed state of the retention component 40 is achieved when the pivoting grabber arm 104 is substantially contained within the grabber slot 102, with a small portion of the pivoting grabber arm 104 extending exterior to the grabber slot 102, as shown in FIG. 10B. Upon contact of the extended portion of the pivoting grabber arm 104 with the target 8, the pivoting grabber arm 104 rotates to a position where the pivoting grabber arm 104 is substantially exterior to the grabber slot 102, thereby achieving the deployed state of the retention device 40, as shown in FIG. 10C.

The total rotation of the pivoting grabber arm 104 is approximately ninety degrees, from a substantially horizontal position contained substantially within the grabber slot 102 to a substantially vertical position extended substantially external to the grabber slot 102. When fully rotated to the substantially vertical position, the pivoting grabber arm 104 most effectively engages and lodges into the target 8.

In one embodiment the pivoting grabber arm 104 may have two grab members 108 situated substantially opposite each other about the fulcrum 106. In this embodiment the grabber slot 102 has a second side substantially opened, opposite the first opened side. Upon contact with the target 8, the pivoting grabber arm 104 rotates to a position where both grab members 108 are substantially exterior to the grabber slot 102 on opposite sides of the nock body 10, thereby providing symmetrical points of contact and minimizing deflection of the arrow 1 from its flight path.

In yet another embodiment of the retention component 40 of the detachable nock 9 having both an undeployed and a deployed state, the retention component 40 is comprised of a mechanical engagement device having a springing action and a trigger mechanism (not shown). In the undeployed state the retention component 40 is situated close to or substantially within the nock body 10, under tension. When the trigger mechanism is engaged, the retention component 40 is moved to its deployed state by the springing action, such that the retention component 40 is situated substantially exterior to the nock body 10 to engage the target 8.

Other embodiments of the retention component 40 may be contemplated and are within the spirit of the present invention.

Among the advantages of the detachable nock 9 are the following. The ability to use a locating device 7 when bow hunting improves the chances of recovering the target animal 8 and reduces the chances of a wounded animal being left to die a lingering death. The detachable nock 9 improves the chances that a locating device 7 delivered by an arrow 1 or contained within the nock 9 will remain with the animal, thereby allowing the locating device 7 to work as intended. The embodiments of the detachable nock 9 which permit multiple points of engagement with the target 8 permit the detachable nock 9 to be detached from the arrow 1 with a reduced risk of deflecting the arrow 1 from its flight path during its transit through the target 8, which a single point of engagement may cause. A deflected arrow 1 may not cleanly pass through the target animal 8, thereby resulting in less blood loss and the possibility of a slower death for the animal. Another advantage of the detachable nock 9 is its close conformity in size, shape, and length to existing nocks, thereby minimizing its impact on the flight of the arrow 1. Bow hunters can also use their preferred model of arrow shaft 2 rather than an expensive custom designed arrow shaft 2. The design of the detachable nock 9 is compatible with most pass-through arrow rests currently in use, allowing bow hunters to combine a wide variety of arrow shafts 2 with broadheads and fletching. The simplicity of the design also allows for a cost-effective manufacture of the detachable nock 9.

Other embodiments not specifically set forth herein are also within the scope of the following claims.

What is claimed:

1. A detachable nock for carrying a locating device with an arrow having a hollow shaft with a front end and a rear end, said arrow having an arrowhead situated at the front end of the shaft and an arrow aperture situated at the rear end of the shaft, said detachable nock separating the locating device from the arrow and securing the locating device to a target, said detachable nock comprising;

a nock body, having a front and a rear;

a means for carrying the locating device, a bowstring receiving means situated at the rear of the nock body;

an attachment component situated at the front of the nock body, said attachment component suitably adapted for removably attaching the detachable nock to the arrow; and a retention component for securing the detachable nock to the target.

2. The detachable nock of claim 1, wherein the means for carrying the locating device comprises a hollow chamber situated within the interior of the nock body and suitably dimensioned to snugly accommodate the locating device so as to prevent movement of the locating device within the nock body when the locating device is inserted within the hollow chamber.

3. The detachable nock of claim 2, wherein the nock body further comprises a forward aperture extending from the hollow chamber through the front of the nock body such that an antenna attached to the locating device may pass out of the hollow chamber through the forward aperture and into the hollow shaft of the arrow.

4. The detachable nock of claim 2, wherein the bowstring receiving means comprises a flanged end cap having a first flange and a second flange, with the first and second flanges depending generally rearward from the flanged end cap and being substantially parallel to each other, and further being oriented to form a vertical notch between the flanges suitably adapted to receive a bow string.

5. The detachable nock of claim 4, wherein the flanged end cap is integrated into the rear of the nock body.

6. The detachable nock of claim 4, wherein the nock body further comprises an aperture situated in the rear of the nock body which provides a communication between the hollow chamber and the exterior of the nock body; and the flanged end cap further comprises a protrusion situated opposite the flanges, with the protrusion being suitably adapted to be removably inserted into the aperture in the rear of the nock body, thereby allowing the flanged end cap to be the securely attached to the nock body while providing access to the hollow chamber.

7. The detachable nock of claim 6, wherein the rear aperture of the nock body is threaded; and the protrusion of the flanged end cap is threaded;

such that the threads of the rear aperture accommodate the threads of the protrusion, thereby allowing the flanged end cap to be screwed into and unscrewed from the nock body while providing access to the hollow chamber.

8. The detachable nock of claim 2, wherein the attachment component is an extension of the nock body projecting from the front of the nock body and aligned longitudinally with the intended direction of the flight of the arrow and having a substantially cylindrical shape, and further comprising an insertion end and a base end, with the insertion end being furthest from the nock body and the base end being nearest and integrated into the nock body, and with the insertion end having a diameter just slightly smaller than the inside diameter of the arrow aperture.

9. The detachable nock of claim 8, wherein the base end of the attachment component has a diameter just slightly greater than the inside diameter of the arrow aperture.

10. The detachable nock of claim 8, further comprising an adaptor, said adaptor having a substantially cylindrical shape and with an outside diameter just slightly smaller than the inside diameter of the arrow aperture such that the adapter is suitably adapted to fit into the arrow aperture and remain secured to the arrow, said adapter having a central aperture passing through its length and aligned substantially along its longitudinal axis, said central aperture defined by an inner surface of the adapter, with a diameter of the central aperture being just slightly greater than the diameter of the insertion end of the attachment component, whereby the adapter receives the attachment component into the central aperture so as to removably attach the detachable nock to the adapter.

11. The detachable nock of claim 10, wherein the base end of the attachment component has a diameter just slightly greater than the diameter of the central aperture of the adapter.

12. The detachable nock of claim 10, wherein the attachment component further comprises one or more annular protrusions formed onto its surface and circumscribing the attachment component, with each annular protrusion being slightly deformable, and the adaptor further comprises a like number of annular channels formed into the inner surface and circumscribing the central aperture, each annular channel suitably adapted to accommodate a corresponding annular protrusion, such that when the attachment component is fully inserted into the central aperture each annular protrusion is aligned with and fits into a corresponding annular channel, thereby removably attaching the detachable nock to the adapter.

13. The detachable nock of claim 10, wherein the attachment component further comprises one or more annular channels formed into its surface and circumscribing the attachment component; and the adaptor further comprises a like number of annular protrusions formed onto the inner surface and circumscribing the central aperture, with each annular protrusion being slightly deformable, each annular channel suitably adapted to accommodate a corresponding annular protrusion, such that when the attachment component is fully inserted into the central aperture each annular protrusion is aligned with and fits into a corresponding annular channel, thereby removably attaching the detachable nock to the adapter.

14. The detachable nock of claim 8, further comprising an adaptor, said adaptor having a substantially cylindrical shape and with an outside diameter just slightly smaller than the inside diameter of the arrow aperture such that the adapter is suitably adapted to fit into the arrow aperture and remain secured to the arrow, and said adapter having a central aperture passing through its length and aligned substantially along its longitudinal axis, said central aperture defined by an inner surface of the adapter; and the attachment component further comprising two or more independent attachment flanges, each attachment flange constructed of a flexible material and being disposed forward from the nock body and oriented substantially parallel to each other, with there being a slight separation between the attachment flanges such that the attachment flanges may flex toward each other, and with the attachment component having a diameter just slightly greater than the diameter of the central aperture of the adapter when the attachment flanges are in their original unflexed orientation and a diameter just slightly smaller than the diameter of the central aperture of the adapter when the attachment flanges are in their flexed orientation.

15. The detachable nock of claim 2, wherein the attachment component is an extension of the nock body projecting from the front of the nock body and aligned longitudinally with the intended direction of the flight of the arrow and having a substantially cylindrical shape, and is comprised of two or more independent attachment flanges, each attachment flange constructed of a flexible material and being disposed forward from the nock body and oriented substantially parallel to each other, with there being a slight separation between the attachment flanges such that the attachment flanges may flex toward each other, the attachment component having a diameter just slightly greater than the inside diameter of the arrow aperture when the attachment flanges are in their original unflexed orientation and a diameter just slightly smaller than the inside diameter of the arrow aperture when the attachment flanges are in their flexed orientation.

16. The detachable nock of claim 2, wherein the retention component comprises a means for creating an impediment to the forward flight of the arrow upon said means coming in contact with the target such that the impediment creates a force in opposition to the forward flight of the arrow sufficient to detach the detachable nock from the arrow, said means being fixed in position relative to the nock body such that the retention component is always deployed and available for engagement upon contact with the target.

17. The detachable nock of claim 16, wherein the means for creating an impediment to the forward flight of the arrow comprises a fixed hook, having:

a shaft;

an attachment end; and a barbed end;

with the attachment end of the fixed hook fixedly attached to the nock body and the shaft of the fixed hook curved towards the front of the nock body such that the barbed end of the fixed hook is forwardly directed towards the arrowhead and situated substantially in a plane aligned with the intended direction of the flight of the arrow.

18. The detachable nock of claim 17, further comprising a plurality of fixed hooks.

19. The detachable nock of claim 16, wherein the means for creating an impediment to the forward flight of the arrow comprises a grab member, having an attachment point and a contact element, with the grab member fixedly attached to the nock body at the attachment point and the contact element oriented so that it presents an impediment to forward motion when it comes in contact with the target.

20. The detachable nock of claim 19, further comprising a plurality of grab members.

21. The detachable nock of claim 19, wherein the grab member is constructed of a deformable material having the ability to flex while being resistant to breaking.

22. The detachable nock of claim 21, further comprising a plurality of grab members.

23. The detachable nock of claim 16, wherein the attachment component is an extension of the nock body projecting from the front of the nock body and aligned longitudinally with the intended direction of the flight of the arrow and having a substantially cylindrical shape, and further comprising an insertion end and a base end, with the insertion end being furthest from the nock body and the base end being nearest and integrated into the nock body, and with the insertion end having a diameter just slightly smaller than the inside diameter of the arrow aperture and the base end having a diameter smaller than the diameter of the nock body, such that a lip is formed at the junction of the base end of the attachment component and the nock body;

and the means for creating an impediment to the forward flight of the arrow comprises a grab ring having an inside diameter just slightly greater than the diameter of the base end of the attachment component and smaller than the outside diameter of the rear end of arrow shaft, with the grab ring suitably adapted to fit over the base end of the attachment component and against the lip.

24. The detachable nock of claim 23, further comprising a grab member, having an attachment point and a contact element, with the grab member fixedly attached to the grab ring by its attachment point and the contact element oriented so that it presents an impediment to forward motion when it comes in contact with the target.

25. The detachable nock of claim 24, further comprising a plurality of grab members.

26. The detachable nock of claim 24, wherein the grab member is constructed of a deformable material having the ability to flex while being resistant to breaking.

27. The detachable nock of claim 26, further comprising a plurality of grab members.

28. The detachable nock of claim 2, wherein the retention component comprises a means for creating an impediment to the forward flight of the arrow upon said means coming in contact with the target such that the impediment creates a force in opposition to the forward flight of the arrow sufficient to detach the detachable nock from the arrow, said means having an undeployed state and a deployed state, with said means in the undeployed state positioned close to or substantially within the nock body and with said means in the deployed state appropriately positioned relative to the nock body to provide increased impediment to the forward flight of the arrow relative to said means in the deployed state, with said means suitably adapted to alter its state from the undeployed state to the deployed state upon contact with the target.

29. The detachable nock of claim 28, wherein the means for creating an impediment to the forward flight of the arrow comprises a hinged hook having:

a grabbing prong, having a barbed end, a shaft, and a hinged end; and a hinge;

with the hinge fixedly attached to the nock body, the hinged end of the grabbing prong movably attached to the hinge such that the grabbing prong pivots forward and backward in a plane aligned with the intended direction of the flight of the arrow, and with the shaft of the grabbing prong curved back toward itself forming a bend such that the barbed end is directed towards the hinged end.

30. The detachable nock of claim 29, further comprising a torsion spring integrated into the hinge and the hinged end of the grabbing prong.

31. The detachable nock of claim 29, further comprising a plurality of hinged hooks for engaging and lodging into the target.

32. The detachable nock of claim 29, wherein the retention component further comprises a barb guard suitably adapted to accommodate the barbed end of the grabbing prong.

33. The detachable nock of claim 32, further comprising a plurality of hinged hooks and a corresponding number of barb guards, each barb guard suitably adapted to accommodate the barbed end of a grabbing prong.

34. The detachable nock of claim 28, wherein the means for creating an impediment to the forward flight of the arrow comprises a pivoting grabber arm situated within a grabber slot, with the grabber slot being a cavity formed within the nock body and having at least one side substantially opened to the exterior of the nock body, and with the pivoting grabber arm being suitably adapted to pivot from a position whereby the pivoting grabber arm is substantially contained within the grabber slot to a position whereby the pivoting grabber arm is positioned substantially exterior to the grabber slot to engage with a target.

35. The detachable nock of claim 34, wherein the pivoting grabber arm is disposed about and rotationally attached to a fulcrum, said fulcrum situated within the grabber slot and fixedly attached to the nock body.

36. The detachable nock of claim 35, wherein the pivoting grabber arm further comprises two grab members situated substantially opposite each other about the fulcrum, and with the grabber slot having a second side substantially opened, situated opposite the first opened side, such that the pivoting grabber arm may rotate about the fulcrum thereby extending both grab members substantially exterior to the grabber slot on opposite sides of the nock body.

* * * * *